US006718584B2

(12) United States Patent
Rabaiotti et al.

(10) Patent No.: US 6,718,584 B2
(45) Date of Patent: Apr. 13, 2004

(54) PATIENT SUPPORT

(75) Inventors: Mario Rabaiotti, Milford Haven (GB); Tariq Khan, Haverfordwest (GB)

(73) Assignee: Technevolve Limited, Worcester (GB)

( * ) Notice: Subject to any disclaimer, the term of this patent is extended or adjusted under 35 U.S.C. 154(b) by 0 days.

(21) Appl. No.: 09/736,033

(22) Filed: Dec. 13, 2000

(65) Prior Publication Data

US 2001/0025391 A1 Oct. 4, 2001

(30) Foreign Application Priority Data

Dec. 14, 1999 (GB) ..... 9929407

(51) Int. Cl.[7] ..... A47C 27/10
(52) U.S. Cl. ..... 5/715; 5/615; 5/713
(58) Field of Search ..... 5/615, 715, 710, 5/706, 713

(56) References Cited

U.S. PATENT DOCUMENTS

| | | | | |
|---|---|---|---|---|
| 1,981,666 A | | 11/1934 | Ridley | |
| 3,477,071 A | * | 11/1969 | Emerson | |
| 3,492,988 A | | 2/1970 | De Maré | |
| 3,775,781 A | | 12/1973 | Bruno et al. | |
| 3,795,021 A | | 3/1974 | Moniot | |
| 3,895,403 A | * | 7/1975 | Davis | |
| 4,428,087 A | | 1/1984 | Horn | |
| 4,977,629 A | * | 12/1990 | Jones | |
| 5,142,720 A | * | 9/1992 | Kelso et al. | |
| 5,394,577 A | | 3/1995 | James et al. | |
| 5,619,764 A | | 4/1997 | Lopau | 5/713 |
| 5,815,862 A | | 10/1998 | Rygiel | 5/632 |
| 6,119,292 A | * | 9/2000 | Haas | |
| 6,154,900 A | * | 12/2000 | Shaw | |

FOREIGN PATENT DOCUMENTS

| | | | |
|---|---|---|---|
| DE | 197 16 268 C1 | 8/1998 | A61H/1/02 |
| DE | 19833047 A1 | 2/2000 | |
| GB | 1 602 682 | 11/1981 | |
| GB | 2 301 0288 | 11/1996 | |
| GB | 2330771 A | 5/1999 | |

* cited by examiner

*Primary Examiner*—Alexander Grosz
(74) *Attorney, Agent, or Firm*—Gordon & Jacobson, P.C.

(57) ABSTRACT

A patient support structure including a unit having at least two defined shaped zones (30, 32) inflatable from a deflated condition in order to modify the topography of the support. One of the zones (30) is larger than the other (32) so that inflation of the larger zone lifts a patient to one side (towards the smaller zone 32) and the inflated smaller zone supports the patient and prevents the patient from slipping off the support structure. In a more preferred embodiment, the support structure comprises two units, each having at least two defined shaped inflatable zones (30, 32), the larger zone 30 of each unit being in opposed configuration and the units being inflatable independently of one another so that a patient can be lifted to one side or the other side according to which unit is inflated.

22 Claims, 5 Drawing Sheets

LIFT LEFT

LIFT RIGHT

PATIENT SUPPORT

BACKGROUND OF THE INVENTION

The present invention relates to patient support and in particular to support of patients in preferred positions for medical examination, surgical operations and the like, particularly but not exclusively suitable for use in operating theatres.

PRIOR ART

U.S. Pat. No. 3,775,781 describes patient turning apparatus comprising an inflatable mattress consisting of two independently inflatable halves. The patient lies in the centre of the mattress and, if he wishes to turn over, one of the inflatable halves can be inflated to change the topography of the mattress and aid the patient in turning in the desired direction. However, such apparatus is too large and cumbersome for use in an operating theatre to enable a surgeon, for example to manipulate an anaesthetised patient. Further, there would be a real danger of the patient simply sliding off the mattress (and possibly off the bed) unless substantial care is taken.

SUMMARY OF THE INVENTION

According to a first aspect, the invention provides a patient support structure including a unit having at least two defined shaped zones inflatable from a deflated condition in order to modify the topography of the support, one of said zones being larger than the other.

The larger inflatable zone is intended to lift or otherwise manipulate or change the position of a patient, while the smaller zone supports the patient and prevents the patient from slipping off the support structure.

The at least two inflatable zones are preferably connected together by a track defining an air flow path therebetween.

In a preferred embodiment, the patient support structure comprises two units as defined in accordance with the first aspect of the present invention, the units being arranged such that the respective larger zones are in opposed configuration, and the units are inflatable independently of one another.

The two units are preferably secured to a base mat, which is beneficially flexible, opposing edges of which are preferably provided with handle members and/or means for securing the opposing edges together when the base mat is in a folded configuration.

According to a second aspect, the present invention provides a disposable patient support structure including at least one defined shaped zone inflatable from a deflated condition in order to modify the topography of the support.

The support structure of either of the two aspects of the invention preferably includes non-inflatable zones.

Desirably, the support structure of the second aspect of the invention includes a plurality of discrete inflatable zones, preferably respectively spaced, beneficially by non-inflatable zones or regions. Respective discrete inflatable zones are preferably inflatable independently of one another.

The inflatable zone or zones of the patient support structure of either of the two aspects of the present invention is/are desirably arranged to produce or induce an inclined topography area when inflated. In a preferred embodiment the inclined topography area includes a leading edge at a position toward a central axis of the support structure.

The inflatable zones preferably comprise membrane or sheet material (typically formed into pockets or pouches) which is resiliently inflatable (elastically deformable).

In one embodiment the support structure comprises a layer structure comprising a base layer, an air distribution layer and a level defining the inflatable zone or zones. In one embodiment the level defining the inflatable zone or zones may comprise a mask sheet including apertures, the mask sheet laying adjacent a layer of resiliently flexible sheet. In operation, pressurised air causes zones of the sheet to inflate through the apertures in the mask sheet. The mask sheet is typically more rigid than the resiliently flexible sheet.

It will be appreciated that the material inflated by the pressurised air is air impermeable.

The present invention extends to patient support apparatus comprising:

i) a patient support structure as defined in accordance with the first or the second aspect of the present invention;

ii) gas supply means arranged to supply gas to inflate the inflatable zones of the support structure; and, iii) control means arranged to control supply of the gas from the gas supply means to the inflatable zones of the support structure.

The control means is beneficially operable to control the gas supply to permit switching of supply between respective discrete inflatable zones of the support structure. The control means is beneficially operable to control the gas supply to permit simultaneous of supply to a plurality of respective discrete inflatable zones of the support structure. The control means is preferably operable to facilitate controlled deflation of inflated zones. Typically the control means comprises a valve arrangement, such as a pneumatic valve arrangement.

According to a further aspect, the invention provides a method of supporting a human or animal body, the method comprising:

i) positioning the body in a prone, supine or lateral position on a patient support structure as defined in accordance with the first or the second aspect of the present invention;

ii) initiating gas supply means to supply gas to inflate the one or more inflatable zones of the support structure in order to modify the topography of the support and move the body from the initial position into a different desired orientation.

The invention will now be further described in specific embodiments by way of example only, and with reference to the accompanying drawings.

DESCRIPTION OF THE INVENTION

Figure 1:
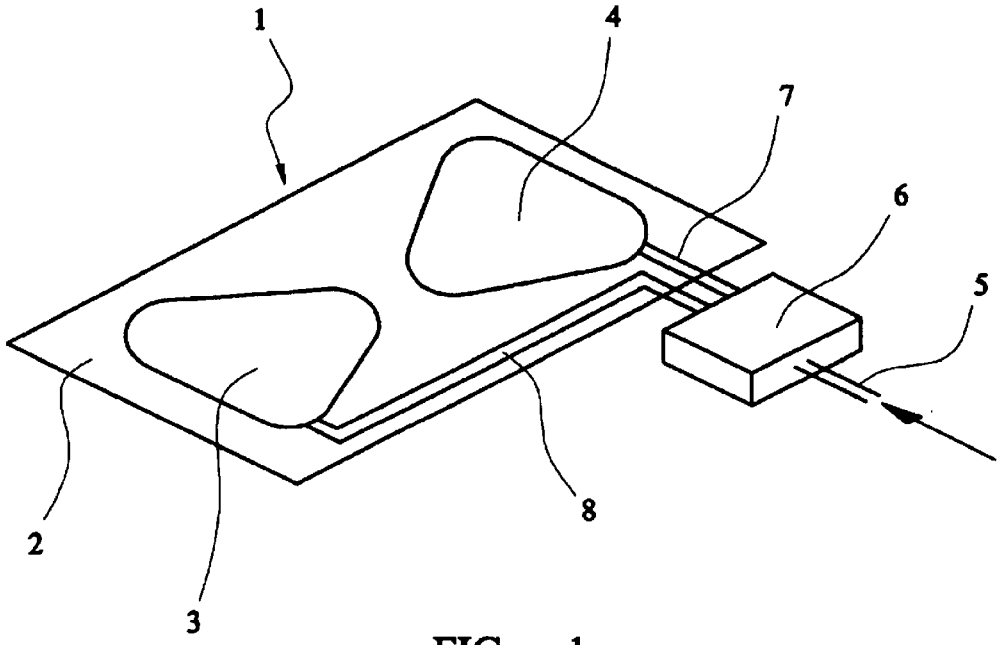
FIG. 1 is a schematic perspective view of a first embodiment of patient support structure and system according to the invention.
Figure 2:
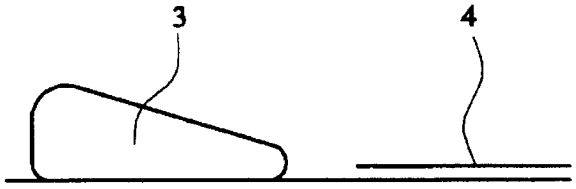
FIGS. 2 and 3 are schematic side views of the arrangement of FIG. 1 showing inflatable pouches (zones) in alternative inflated configurations.
Figure 3:
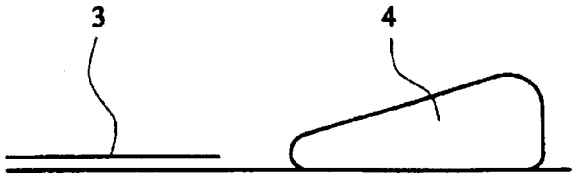

Referring to the drawings, and initially to FIGS. 1 to 3, there is shown a patient support structure (generally designated 1) comprising a flat polymer base mat 2 (which may be rigid or flexible), to which inflatable pouches 3, 4 are secured by adhesive bonding or welding to the base layer 2.

Pouches 3, 4 are resiliently flexible such that they tend to revert to their deflated position when the supply of pressurising air is switched off. Pouches 3, 4 are shaped such that, when inflated, a tapering wedge is formed having a surface extending upwardly away from a leading edge positioned towards the transverse axis of the mat. Pouches 3, 4 are in opposed configuration such that a patient lying across the mat would be lifted to one side or the other depending upon which of the pouches is inflated.

A pneumatic air supply is ducted into the pouches 3, 4 via an air line 5 which passes through a pneumatic control arrangement 6 which includes pneumatic valves to distribute the compressed air via supply lines 7, 8. Pneumatic control arrangement 6 may be used to control switching of the air supply via lines 7, 8 to the desired pouch 3, 4. As shown in FIGS. 2 and 3, when the respective pouch 3, 4 is in the deflated condition, the surface of the pouch lies substantially flush with the flexible base layer mat 2. When expanded, the support surface of the relevant pouch stands proud of the base layer mat 2.

Figure 4:
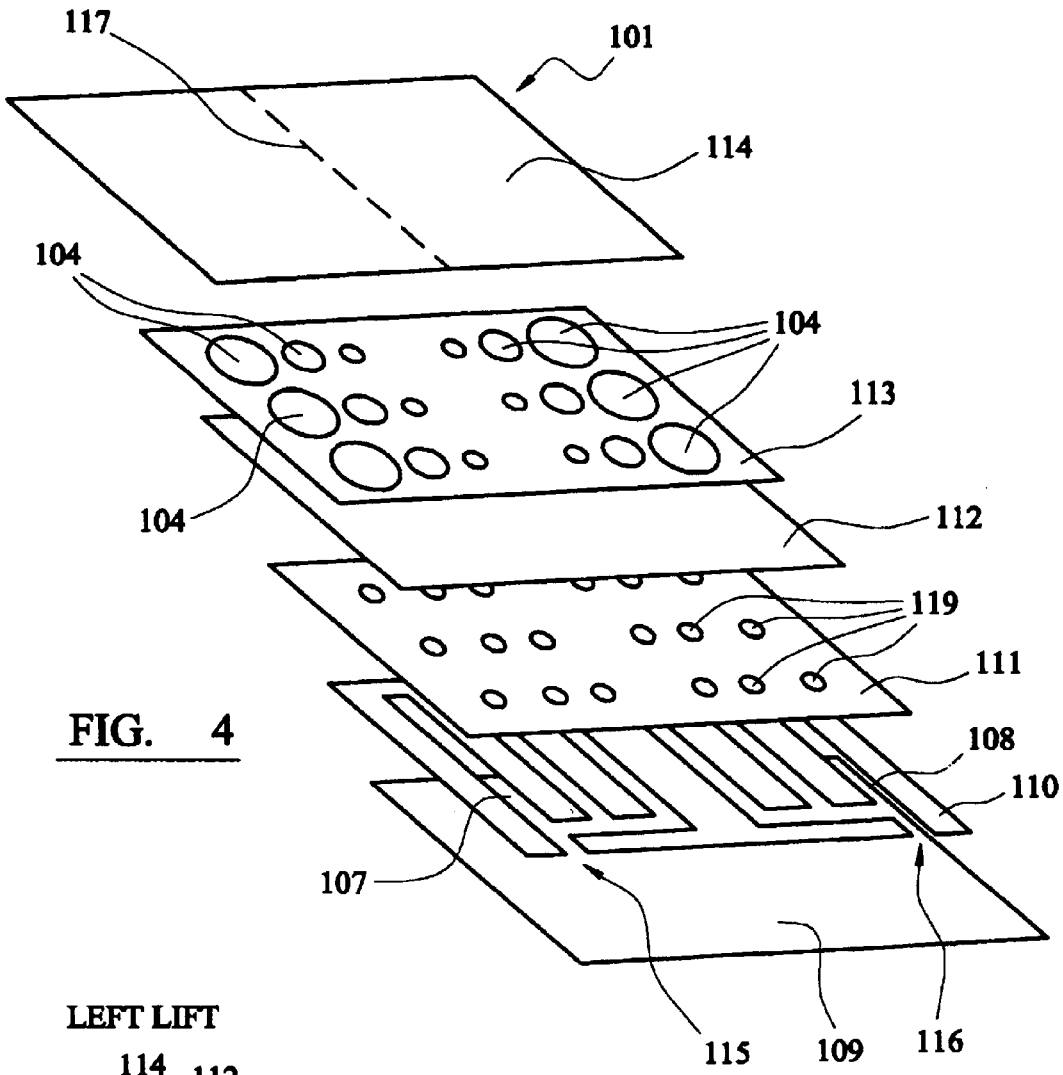
FIG. 4 is a perspective exploded view of an a second exemplary embodiment of a patient support structure according to the invention.
Figure 5:
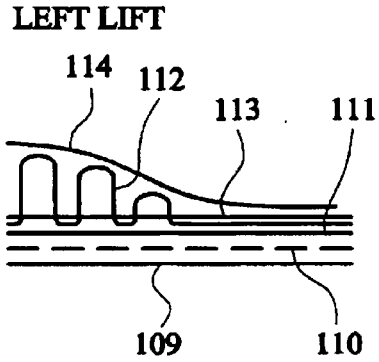
FIGS. 5 and 6 correspond to the views of FIGS. 2 and 3 but in relation to the support structure of FIG. 4.
Figure 6:
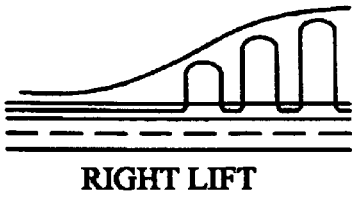

Referring now to FIGS. 4 to 6, there is shown a more complex arrangement of a support structure according to the invention. In the multi-layer arrangement shown, the support structure comprises a plurality of layers 109, 110, 111, 112, 113, 114. Base layer 109 comprises a flexible polymer (or rigid polymer) layer. Layer 110 is configured with a pre-slotted or cutout track 108, 107 which has mouth portions 115, 116 through which the compressed air is supplied into the structure. The tracks 107, 108 define air flow paths for inflation. Layer 110 is sandwiched between the base layer 109 and an overlayer 111 which includes a plurality of apertures 119 arranged to overlay portions of the slotted tracks 107, 108, and also be aligned with apertures in an above laying mask sheet 113 (as will be described in more detail below).

Overlaying layer 111 is a layer 112 of flexible, resiliently expandable sheet (typically latex). Layer 113 overlays layer 112 and is substantially more rigid than layer 112. Layer 113 comprises a mask layer including a predetermined arrangement of shaped aperture zones 104. Layers 109, 110, 111, 112 and 113 are secured together (typically by bonding with adhesive or welding) to form a unitary structure. Layer 114 comprises a flexible conformable sheet which overlays the bonded structure and is secured along a bonded centre line 117 extending in the direction of the transverse axis of the structure.

In operation, air is supplied to the bonded layer structure via inlets 115, 116 leading into tracks 107, 108. The pressurised air is directed upwardly through the structure via apertures 119 such that relevant portions of the resiliently expandable layer 112 are forced (stretched) upwardly through the overlaying aperture zones 104 of mask layer 113, thereby forcing upwardly the relevant portion of the overlaying flexible conformable sheet 114. The ducted air thereby changes the topography of the patient supporting surface (sheet 114 overlying mask layer 113) dependent upon the control of the air supply to the structure.

The aperture zones 104 of mask layer 113 are graded in size in a direction outwardly from the transverse axis of the structure such that the size of the aperture increases with distance outwardly from the transverse axis. This provides that, when air is ducted to the relevant side of the structure, the flexible expandable sheet 112 causes the topography to be deformed to form an upwardly inclined support configuration extending from the relatively narrow portion (leading edge) proximate the transverse axis of the structure, to a relatively more upstanding portion toward the outer edge of the structure. This is shown most clearly in FIGS. 5 and 6.

Typically, as described in relation to the support structure of FIG. 1, compressed air is directed via a relevant pneumatic control arrangement to enable air to be conducted to the opposed sides of the support structure as required.

Figure 7:
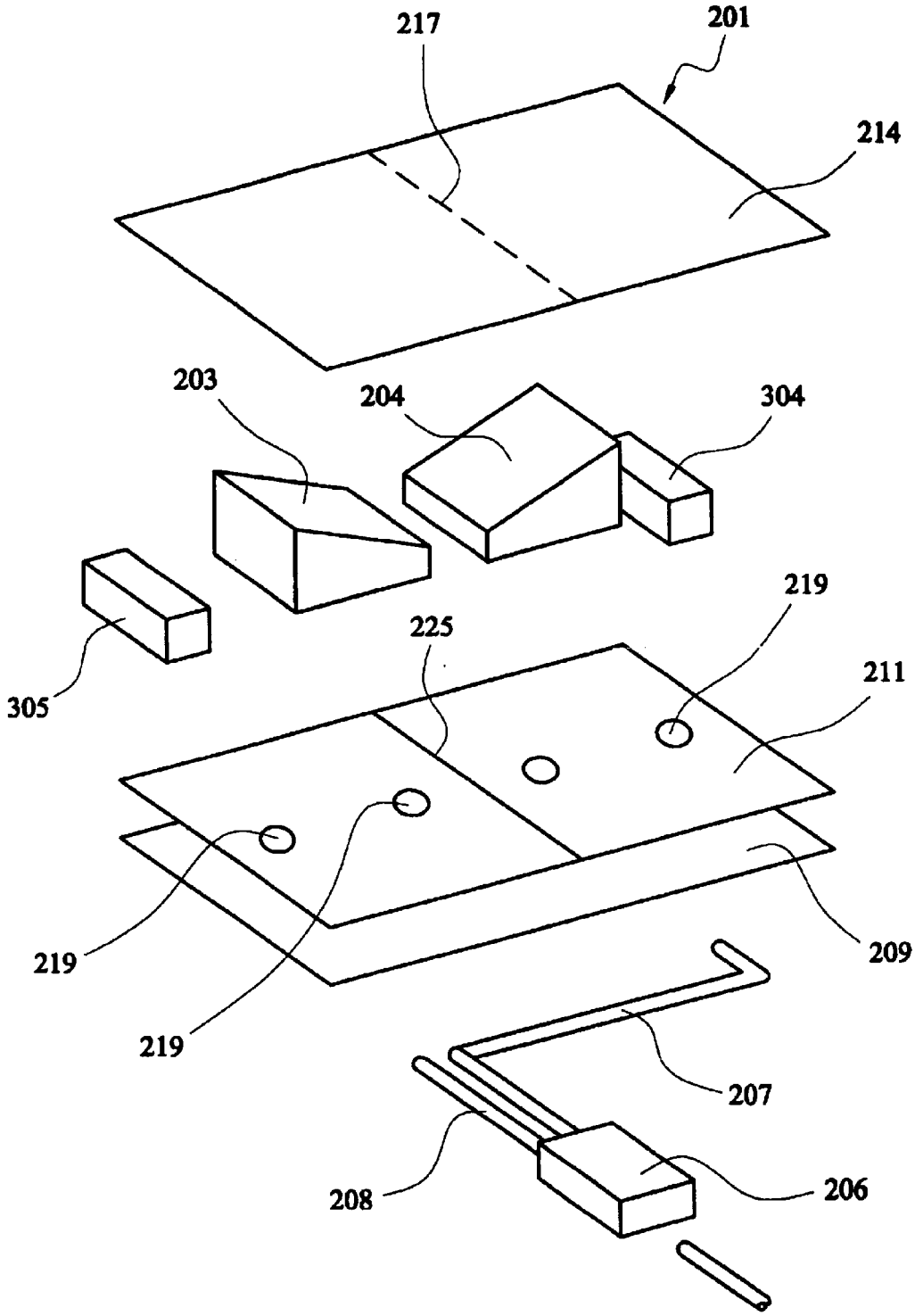
FIG. 7 is a perspective exploded view of a third exemplary embodiment of a patient support structure according to the invention.

Referring now to FIG. 7, there is shown a further embodiment of a patient support structure 201 according to the invention. In the arrangement shown a cover sheet 211 and base layer 209 are welded about their peripheral margins to one another, and also along a weld line 225 in the transverse axial direction of the structure. Supply lines 207, 208 supply compressed air to the respective sealed zones between cover sheet 211 and base layer 209. Cover sheet 211 includes air communication apertures 219 permitting compressed air to pass upwardly into shaped resiliently inflatable (typically elastomer) pouches 203, 204, 303, 304. Cover sheet 214 overlies the layer of pouches, and is secured to sheet 211 along a weld line 217 in the transverse axial direction of the structure. In the same way as for previously described embodiments, a pneumatic control arrangement 206 is used to direct compressed air for inflation to the relevant portions of the structure.

Figure 8:
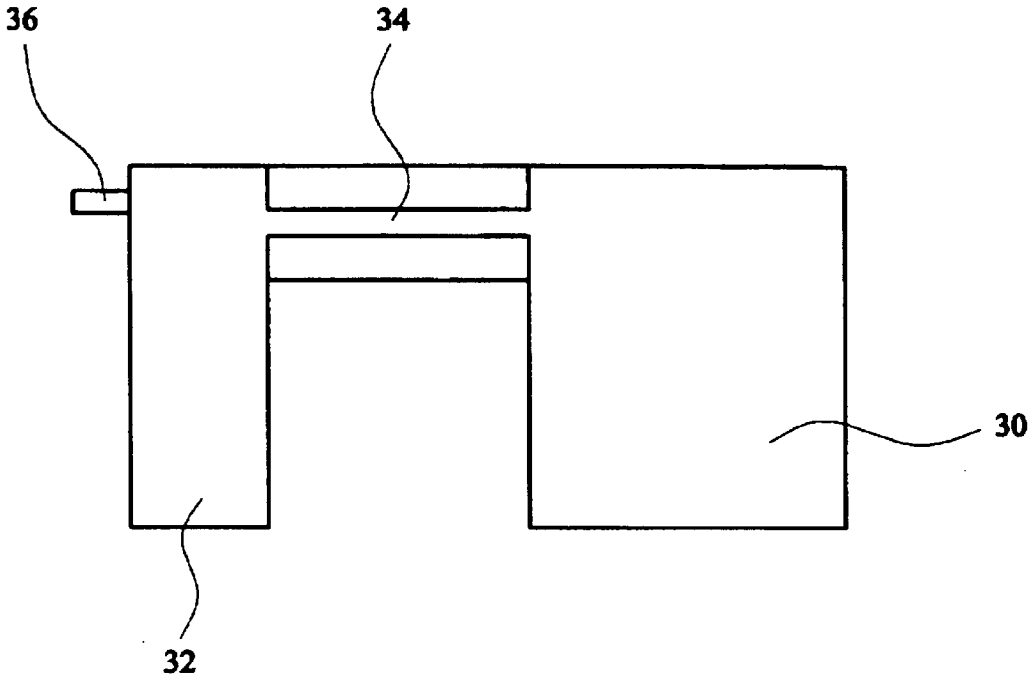
FIG. 8 is a plan view of a fourth exemplary embodiment of a patient support structure according to the invention.

Referring to FIG. 8 of the drawings, there is shown a patient support structure according to another embodiment of the present invention. The support structure comprises two inflatable pouches 30, 32 which are connected together by a track 34 defining an air flow path between the pouches 30, 32. A pneumatic air supply is ducted into the pouches 30, 32 via an air line 36. Pouches 30, 32 are resiliently flexible such that they tend to revert to their deflated position when the supply of pressurising air is switched off.

As shown, one of the inflatable pouches 30 is substantially wider than the other inflatable pouch 32. In use, when pressurised air is introduced into the support structure, both pouches 30, 32 inflate. The part of the patient's body required to be manipulated during surgery lies between the two pouches 30, 32. Inflation of the larger pouch 30 causes the body part to be lifted to one side (towards the smaller pouch 32) while the inflated smaller pouch 32 supports the body part and prevents it from slipping off the support structure. The structure can be turned around to lift the patient to the other side.

Figure 9:
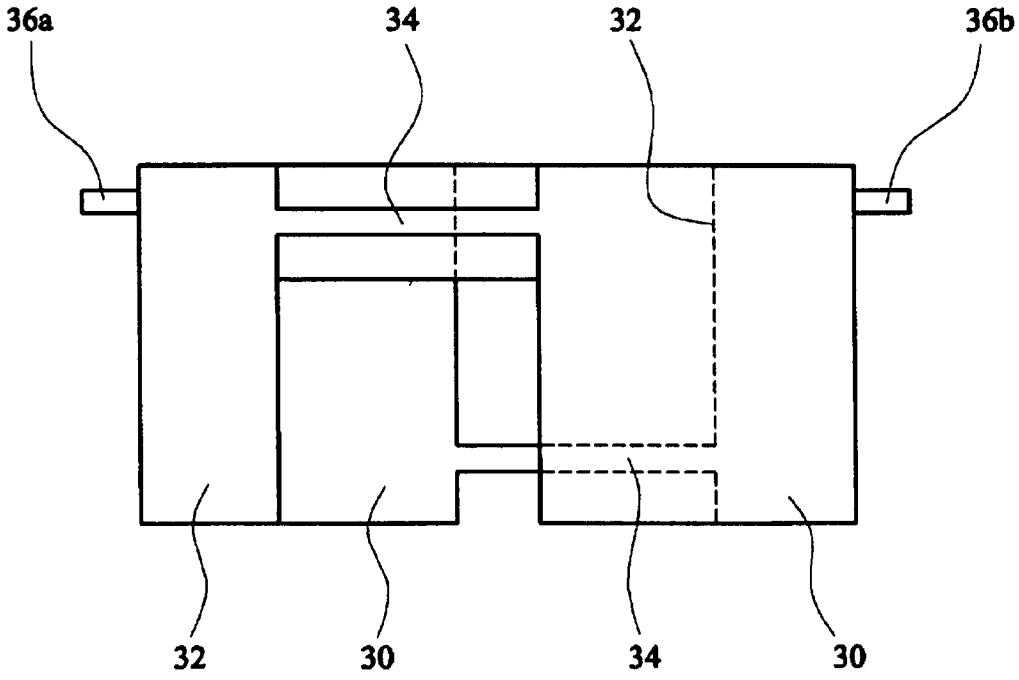
FIG. 9 is a schematic plan view of a patient support structure according to a fifth exemplary embodiment of the present invention.

Referring to FIG. 9 of the drawings, in a preferred embodiment, the support structure comprises two units such as that described with reference to FIG. 8. As shown, the units are preferably in opposed configuration and connected together, generally centrally. The units are inflatable independently of one another, such that a patient lying across the structure would be lifted to one side or the other depending upon which of the units is inflated. An air line 36*a*, 36*b* is provided for each of the units, the air lines 36*a*, 36*b* passing through a pneumatic control arrangement (not shown) which may be used to control switching of the pneumatic air supply to the desired unit.

Figure 10:
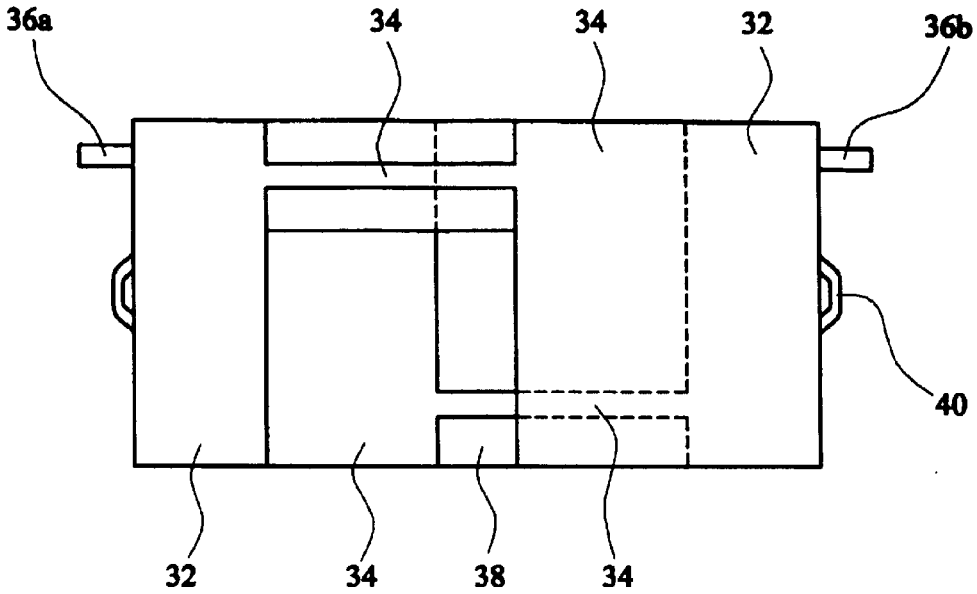
FIG. 10 is a schematic plan view of a patient support structure according to a sixth exemplary embodiment of the present invention.
Figure 11:
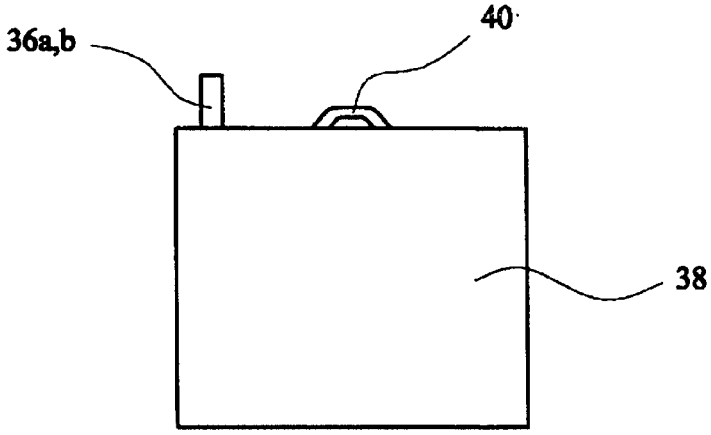
FIG. 11 is a side view of the patient support structure of FIG. 10, when in the folded configuration.
Figure 12:
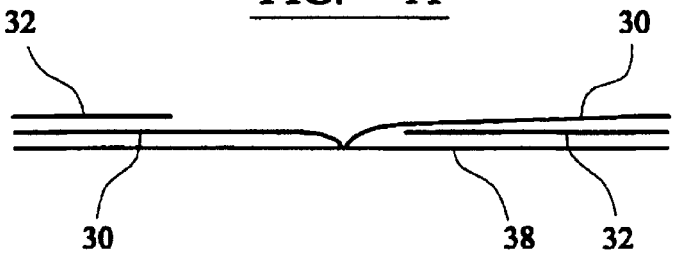
FIG. 12 is a schematic cross-sectional view of the patient support structure of FIG. 10, illustrating its layered construction.

Referring to FIGS. 10 to 12 of the drawings, the arrangement described with reference to FIG. 9 of the drawings is secured (by adhesive bonding, welding, or the like) to a flat polymer base mat 38, which may be rigid but is preferably flexible. Handles 40 are provided on opposing edges of the base mat 38, such that when the structure is folded in half, it is easily transportable (see FIG. 11).

In the case of all of the described embodiments of the invention, the support structure may be made of relatively thin plastics material, or the like, so as to provide disposable arrangements.

The patient support structure may be used in situations where the patient needs to be moved from a prone position, for example prior to or during surgery, for medical examination (where a patient is for example disabled) and for other therapeutic treatments. The pneumatic inflation arrangement is highly controllable.

Embodiments of the present invention have been described above by way of examples only, and it will be apparent to a person skilled in the art that modifications and variations can be made to the described embodiments without departing from the scope of the invention as claimed.

What is claimed is:

1. A patient support structure comprising:

two units, each unit having at least two defined shaped zones (30,32) connected together by a track (34) defining a substantially free air flow path therebetween, one of said zones (30) in each unit being larger than the other respective zone (32), the units being arranged such that the respective larger zones (30) are in opposed configuration, and said at least two defined shaped zones (30,32) of each unit being inflatable from a deflated condition in order to modify the topography of the support structure, said units being inflatable independently of one another.

2. A patient support structure according to claim 1, wherein:

said two units are secured to a base mat (38) having opposing edges.

3. A patient support structure according to claim 2, wherein:

said base mat (38) is flexible.

4. A patient support structure according to claim 3, wherein:

said opposing edges of said base mat (38) are provided with handle members (40).

5. A patient support structure according to claim 3, further comprising:

means for securing said opposing edges together.

6. A patient support structure according to claim 1, wherein:

said support structure includes at least one non inflatable zone.

7. A patient support structure according to claim 1, wherein:

at least one of said inflatable zones is arranged to produce or induce an inclined topography area when inflated.

8. A patient support structure according to claim 1, wherein:

the inflatable zones comprise sheet material which is elastically deformable.

9. A patient support structure according to claim 8, wherein:

said sheet material is formed into one or more pouches.

10. A patient support structure according to claim 1, further comprising:

gas supply means arranged to supply gas to inflate the inflatable zones of the support structure; and control means (206) arranged to control supply of the gas from the gas supply means to the at least two inflatable zones of each unit.

11. A patient support structure according to claim 10, wherein:

said control means (206) is operable to control the gas supply to permit switching of supply between respective units of the support structure.

12. A patient support structure according to claim 10, wherein:

said control means (206) is operable to control the gas supply to permit simultaneous supply to a plurality of respective discrete inflatable zones of the support structure.

13. A patient support device, comprising:

at least one unit having at least one large inflatable pouch (30) and at least one small inflatable pouch (32), the large and small inflatable pouches (30,32) spaced apart sufficiently to provide an area for at least a portion of the patient's body and being connected together by a track (34) defining a substantially free air flow between them, such that the large and small pouches may be inflated substantially simultaneously upon introduction of air into the unit, the unit being arranged to act in its inflated condition such that the large pouch lifts the patient and the small pouch provides support.

14. A patient support structure according to claim 13, wherein:

said support structure includes at least one non-inflatable zone.

15. A patient support structure according to claim 13, wherein:

at least one of said inflatable pouches (30,32) is arranged to produce or induce an inclined topography area when inflated.

16. A patient support structure according to claim 13, wherein:

the inflatable pouches (30,32) comprise sheet material which is elastically deformable.

17. A patient support structure according to claim 13, further comprising:

gas supply means arranged to supply gas to inflate the inflatable pouches (30,32) of the at least one unit and control means (206) arranged to control supply of the gas from the gas supply means to the inflatable pouches (30,32) of the at least one unit.

18. A patient support structure according to claim 17, wherein:

said control means (206) is operable to facilitate controlled deflation of said inflatable pouches (30,32).

19. A patient support structure according to claim 17, wherein:

said control means (206) comprises a valve arrangement.

20. A patient support structure according to claim 17, wherein:

said valve arrangement (206) is a pneumatic valve arrangement.

21. A patient support device comprising:

two units, each unit comprising a large inflatable pouch (30) and a small inflatable pouch (32), the large and small inflatable pouches (30,32) of each unit being connected together by a track (34) defining a substantially free air flow between them, and defining a space or area between them where a patient is intended to be positioned, in use, such that the large and small pouches (30, 32) of each unit may be inflated substantially simultaneously upon introduction of air into the unit.

the unit being arranged to act in its inflated condition such that the large pouch lifts the patient and the small pouch provides support, the units being arranged such that the respective large pouches are in opposed configuration, and wherein said units are inflatable independently of one another.

22. A method of supporting a human or animal body, the method comprising:

positioning the body in a prone, supine or lateral position on a support structure, the support structure having at least one unit having at least one large inflatable pouch (30) and at least one small inflatable pouch (32), spaced apart sufficiently to provide an area for at least a portion of the body, the large and small inflatable pouches (30,32) being connected together by a track (34) defining a substantially free air flow between them, the body being positioned in the area between the large and small inflatable pouches (30,32) of the support structure; and initiating gas supply means to supply gas to inflate the large and small inflatable pouches (30,32) substantially simultaneously in order that the inflated large pouch (30) lifts the body and moves the body from the initial position into a different desired orientation, and the inflated small pouch (32) supports the body.

* * * * *